United States Patent [19]

Anbe

[11] Patent Number: 4,506,532

[45] Date of Patent: Mar. 26, 1985

[54] METHOD FOR CONTROLLING CONTINUOUS ROLLING MILL AND CONTROL APPARATUS THEREFOR

[75] Inventor: Yoshiharu Anbe, Tokyo, Japan

[73] Assignee: Tokyo Shibaura Denki Kabushiki Kaisha, Kawasaki, Japan

[21] Appl. No.: 462,965

[22] Filed: Feb. 1, 1983

[30] Foreign Application Priority Data

Feb. 5, 1982 [JP] Japan ..... 57-17321

[51] Int. Cl.[3] ..... B21B 37/14

[52] U.S. Cl. ..... 72/8; 72/234; 72/240

[58] Field of Search ..... 72/8, 11, 16, 240, 234; 364/472

[56] References Cited

U.S. PATENT DOCUMENTS

| | | | |
|---|---|---|---|
| 4,011,743 | 3/1977 | Peterson et al. | 72/240 |
| 4,030,326 | 6/1977 | Morooka et al. | 72/8 |
| 4,335,435 | 6/1982 | Miura | 72/240 |

OTHER PUBLICATIONS

IAS, Annual Meeting, IEEE Industry Applications Society, 1977 K. Sekiguchi, "Dynamic Schedule Change In Tandem Cold Mill".

*Primary Examiner*—Lowell A. Larson

*Attorney, Agent, or Firm*—Oblon, Fisher, Spivak, McClelland & Maier

[57] ABSTRACT

The invention provides a method for controlling a continuous rolling mill having at least ith and (i+1)th stands and a control apparatus therefor, wherein an exit strip thickness reference value of an automatic gauge control is changed in accordance with a predetermined strip length during size changing and roll gap is corrected so as to change a strip thickness at an exit side of the ith stand, when a size (e.g., thickness) is changed during rolling, and, at the same time, a roll peripheral speed of the ith stand is changed in correspondence with a change in forward slip (a change in entry strip thickness, a change in exit strip thickness, and a change in resistance to deformation) of the ith stand as well as changes in forward slip, exit strip thickness, entry strip thickness and roll peripheral speed of the (i+1)th stand, so as to make the strip speed at the exit side of the ith stand coincide with that at the entry side of the (i+1)th stand, thereby minimizing the interstand tension and performing smooth size changing.

3 Claims, 6 Drawing Figures

METHOD FOR CONTROLLING CONTINUOUS ROLLING MILL AND CONTROL APPARATUS THEREFOR

BACKGROUND OF THE INVENTION

I. Field of the Invention

The present invention relates to a method for controlling a continuous rolling mill and to a control apparatus therefor, wherein exit strip dimensions, such as thickness, are changed during rolling so as to obtain rolled products having different dimensions.

II. Description of the Prior Art

In the iron and steel industry, manufacturing equipment tends to become large in an effort to improve productivity. Along with this tendency, the weight of the slab or the sheet bars supplied to continuous tandem mill plants is also increasing. Therefore, the unit weight of coils manufactured by such continuous tandem mills increases accordingly. However, since users require steel plates of various sizes, a control technique is required to change the exit strip size, that is, the size of a product, during rolling without degrading productivity.

A method is conventionally proposed to control a continuous tandem cold mill as follows. The pass schedule before the size change is defined as schedule A. Under schedule A, the exit strip thickness, the roll gap, and the roll speed are not changed. The pass schedule after size change is defined as schedule B. The schedule operating during the transition period while changing the schedules from A to B is defined as schedule C. The schedules A to C are computed before rolling in accordance with setting operations (operations for setting the roll gap and the roll speed in accordance with the capacity of the equipment, the material used, the the strip to be rolled as the final product). When a size changing point X reaches each of the strands of the continouous tandem cold mill, the schedules A, C and B are performed in the order named, so that the roll gap and the roll speed are changed to obtain strips of different size.

In the control method of the type described above, the roll gaps and roll speeds must be computed in advance for the schedules A, B and C. The control is independent of the rolling conditions and is performed in accordance with the preset values. Therefore, when changes such as resistance to deformation (caused by material hardness, material temperature or a friction coefficient between the roll and material), a difference between the entry and exit strip sizes, a forward slip, or a rolling force occur during the rolling process, an error will occur in the product.

SUMMARY OF THE INVENTION

The present invention has been made to eliminate the conventional drawbacks, and has for its object to provide a method for controlling a continuous rolling mill and a control apparatus therefor, wherein a deviation in an interstand tension is small when a size change is performed during rolling, even if rolling conditions spontaneously change during rolling at any stand of the continuous rolling mill, thus smoothly changing the strip size.

In order to achieve the above object of the present invention, there are provided a method for controlling a continuous rolling mill having at least ith and (i+1)th stands and a control apparatus therefor, wherein an exit strip thickness reference value of an automatic gauge control is changed in accordance with a predetermined strip length during size changing and roll gap is corrected so as to change a strip thickness at an exit of the ith stand whenever a size (e.g., thickness) is changed during rolling, and, at the same time, a roll peripheral speed of the ith stand is changed corresponding to a change in forward slip (or to a change in entry strip thickness, a change in exit strip thickness, or a change in resistance to deformation) of the ith stand as well as changes in forward slip, exit strip thickness, entry strip thickness and roll peripheral speed of the (i+1)th stand, in accordance with the following equations, so as to make the strip speed at the exit side of the ith stand coincide with that at the entry side of the (i+1)th stand:

$$\Delta V_{Ri}/V_{Ri} = -\Delta f_i/(1+f_i) + \Delta f_{i+1}/(1+f_{i+1}) + \Delta h_{i+1}/h_{i+1} - \Delta H_{i+1}/H_{i+1} + \Delta V_{Ri+1}/V_{Ri+1}$$

where $V_R$: roll peripheral speed
f: forward slip
h: exit strip thickness
H: entry strip thickness
i, i+1: stand numbers
Δ: a small change and $$\Delta f_i = (\partial f_i/\partial H_i)\Delta H_i + (\partial f_i/\partial h_i)\Delta h_i + (\partial f_i/\partial k_i)\Delta k_i$$

where k: strip resistance to deformation
∂f/∂H: partial differential coefficient
∂f/∂h: partial differential coefficient
∂f/∂k: partial differential coefficient

DETAILED DESCRIPTION OF THE PREFERRED EMBODIMENT

Before an embodiment of the present invention is described in detail, the principle of the present invention will be described. The pass schedule before size change is defined as schedule A, under which the exit strip thickness, the roll gap and the roll speed of each stand remain fixed. The pass schedule after size change is defined as schedule B, under which the exit strip thickness, the roll gap and the roll speed of each stand have been changed. The duration of a size change during rolling, that is, the period during which schedule A is changed to schedule B, is defined as the transient duration.

Figure 1:
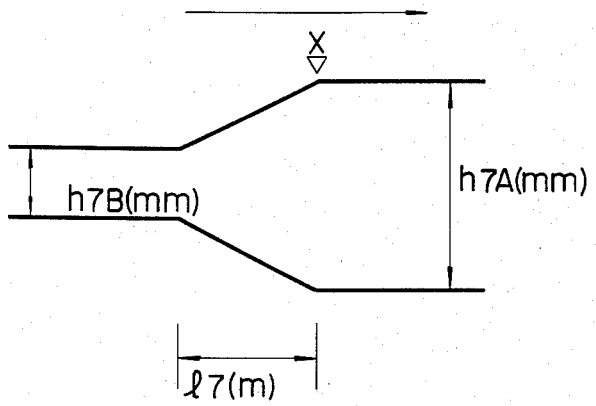
FIG. 1 is a model for explaining strip thickness changing at the exit side of the continuous rolling mill to which the present invention is applied.

Assume that schedule A is changed to schedule B so as to change the exit strip thickness at the exit side of the final stand, as shown in FIG. 1. A hot strip finish rolling mill (seven stands) is used as a continuous rolling mill. The exit strip thickness of the seventh stand for schedule A is defined as $h_{7A}$ (mm), the exit strip thickness of the seventh stand for schedule B is defined as $h_{7B}$ (mm), and the strip length produced during size changing at the exit side of the seventh stand is defined as $l_7$ (m).

At the ith stand (i=1 to 7) of the finishing mill, the exit strip thickness of the ith stand for schedule A is defined as $h_{iA}$ (mm), the exit strip thickness of the ith stand for schedule B is defined as $h_{iB}$ (mm), and the strip length during size changing at the ith stand is defined as $l_i$ (m). If the mass flow of the strip passing through the ith stand during size changing is regarded as being equal to that of the strip passing through the seventh stand during size changing, the following equation is given:

$$l_i(h_{iA}+h_{iB})=l_7(h_{7A}+h_{7B}) \quad (1)$$

Therefore, $$l_i=\{(h_{7A}+h_{7B})/(h_{iA}+h_{iB})\}l_7 \quad (2)$$

Figure 2:
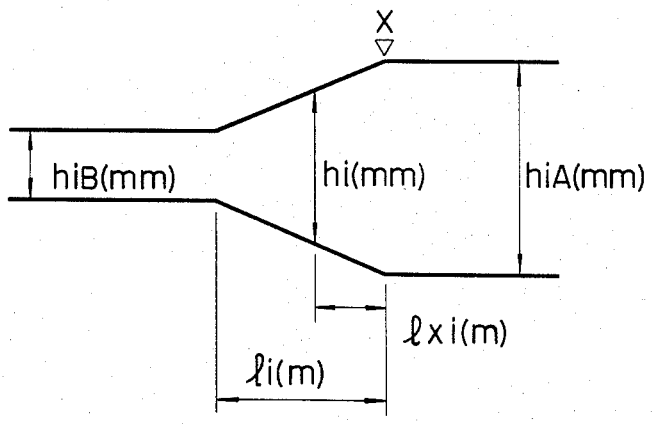
FIG. 2 is a model for explaining strip thickness changing at the exit side of each stand of the continuous rolling mill to which the present invention is applied, with X representing a changing point.

At the ith stand, at a point where the strip length at the exit is spaced apart by $l_{Xi}$ (m) from a size changing point X as shown in FIG. 2, the exit strip thickness $h_i$ of the ith stand is given by the following equation:

$$h_i=h_{iA}-\{(h_{iA}-h_{iB})/l_i\}l_{Xi} \quad (3)$$

The method for controlling the continuous rolling mill according to the present invention includes first and second steps to be described hereinafter. In the first step, the exit strip thickness $h_i$ of the ith stand which is obtained by equation (3) is used as an exit strip thickness reference value of the automatic gauge control, so that the roll gap of the ith stand of the rolling mill can be spontaneously changed during rolling. In the example shown in FIG. 1, each time the size changing point X reaches the first stand to the seventh stand respectively of the finishing mill, the exit strip thicknesses at the exits of all the stands are respectively supplied as the exit strip thickness reference values to the automatic gauge controls of the stands. The roll gaps of the stands are respectively changed during rolling so as to change schedule A to schedule B.

In the second step, when the strip thickness is changed during rolling, the interstand tension must not be changed even though the roll gaps of the stands are changed. For this purpose, the roll speeds of the stands must be changed simultaneously when the roll gaps are changed. At each stand of the continuous rolling mill, rolling conditions (resistance to deformation caused by material hardness, material temperature, or a change in the friction coefficient between the roll and the material; strip sizes at the entry and exit sides of the stand; forward slip; and rolling force) are spontaneously changed. In the second step of the present invention, data of resistance to deformation caused by material temperature and data of strip sizes at the entry and exit sides are supplied from the ith stand to the (i+1)th stand in synchronism with the exit strip speed. Thus, the roll speeds of the stands are controlled so as to obtain a constant mass flow between the ith and (i+1)th stands; this is called constant mass flow control hereinafter.

Figure 3:
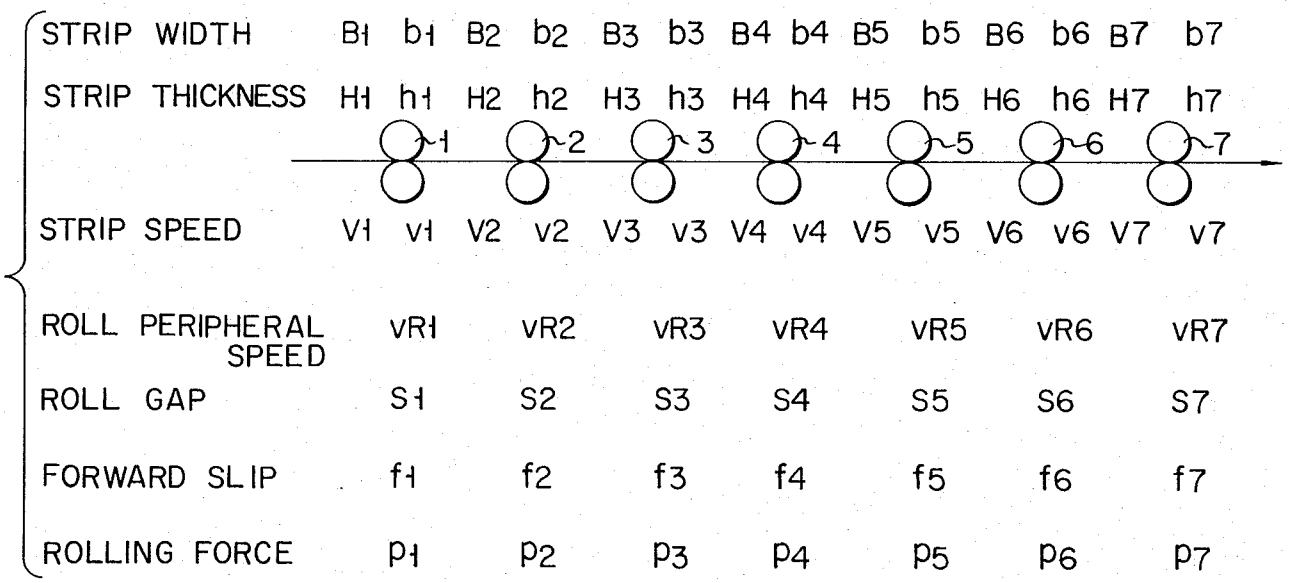
FIG. 3 is a model for explaining the overall structure of a 7-stand continuous rolling mill so as to explain the principle of the present invention.

The constant mass flow control will be described in detail. FIG. 3 shows a 7-stand continuous rolling mill. Referring to FIG. 3, rolls 1 to 7 are respectively disposed at the first to seventh stands. Assume that, at the ith stand, the entry strip width is defined as $B_i$, the exit strip width is defined as $b_i$, the entry strip thickness is defined as $H_i$, the exit strip thickness is defined as $h_i$, the entry strip speed is defined as $V_i$, and the exit strip speed is defined as $v_i$. Also assume that, at the ith stand, the roll peripheral speed is defined as $v_{Ri}$, the forward slip is defined as $f_i$, the roll gap is defined as $S_i$, and the rolling force is defined as $P_i$. At the ith stand, the following equations are given:

$$v_i=v_{Ri}(1+f_i) \quad (4)$$

$$B_iH_iV_i=b_ih_iv_i \quad (5)$$

When a width deviation caused by rolling or the like is neglected, equation (5) can be represented as follows:

$$H_iV_i=h_iv_i \quad (6)$$

The exit strip thickness of the ith stand is given as follows:

$$h_i=S_i+(P_i/M_i) \quad (7)$$

where $M_i$ is the mill spring constant of the ith stand.

In the constant mass flow control system, the roll peripheral speed at the ith stand (or at the (i+1)th stand) is corrected, so that the exit strip speed $v_i$ at the ith stand at an arbitrary time becomes equal to the entry strip speed $V_{i+1}$ at the (i+1)th stand as follows:

$$v_i=V_{i+1} \quad (8)$$

Even during a size change operation during rolling, the interstand tension between the ith and (i+1)th stands remains constant, thus performing stable size changing during rolling.

When equation (6) is applied for the (i+1)th stand, it is represented as follows:

$$H_{i+1}\cdot V_{i+1}=h_{i+1}\cdot v_{i+1} \quad (9)$$

Equation (8) may be substituted into equation (9) to obtain the following equation:

$$H_{i+1}\cdot v_i=h_{i+1}\cdot v_{i+1} \quad (10)$$

Equation (4) may be substituted into equation (10):

$$H_{i+1}\cdot v_{Ri}(1+f_i)=h_{i+1}\cdot v_{i+1} \quad (11)$$

The exit strip speed $v_{i+1}$ of equation (11) is used for the (i+1)th stand with reference to equation (4), thus representing equation (11) in the following manner:

$$H_{i+1}\cdot V_{Ri}(1+f_i)=h_{i+1}\cdot v_{Ri+1}(1+f_{i+1}) \quad (12)$$

Equation (12) can be rewritten as:

$$v_{Ri}=\{(1+f_{i+1})/(1+f_i)\}(h_{i+1}/H_{i+1})v_{Ri+1} \quad (13)$$

Equation (13) is differentiated to obtain the small change $\Delta v_{Ri}$ as follows:

$$\Delta v_{Ri}=(\partial v_{Ri}/\partial f_i)\Delta f_i+(\partial v_{Ri}/\partial f_{i+1})\Delta f_{i+1}+(\partial v_{Ri}/\partial h_{i+1})\Delta h_{i+1}+(\partial v_{Ri}/\partial H_{i+1})\Delta H_{i+1}+(\partial v_{Ri}/\partial v_{Ri+1})\Delta_{Ri+1} \quad (14)$$

where $(\partial v_{Ri}/\partial f_i)$, $(\partial v_{Ri}/\partial f_{i+1})$, $(\partial v_{Ri}/\partial h_{i+1})$, $(\partial v_{Ri}/\partial H_{i+1})$, and $(\partial v_{Ri}/\partial v_{Ri+1})$ are partial differential coefficients, respectively. According to equations (13) and (14), $$\Delta v_{Ri}/v_{Ri} = -\Delta f_i/(1+f_1) + \Delta f_{i+1}/(1+f_{i+1}) + \Delta h_{i+1}/h_{i+1} - \Delta H_{i+1}/H_{i+1} \Delta v_{Ri+1}/v_{Ri+1} \quad (15)$$

Equation (15) is the fundamental relation for performing constant mass flow control. The roll peripheral speed of the ith stand is controlled corresponding to a change in the roll peripheral speed of the (i+1)th stand so as to satisfy equation (15).

A case will be considered relating to the 7-stand hot strip finishing mill (FIG. 3). The seventh stand is generally the reference stand of the finishing mill. Since the speed of the seventh stand is the reference, equation (15) must be rewritten six times for i=1 to 6.

The forward slip $f_i$ of equation (15) can be obtained by the following known equation (15)-1:

$$f_i = \tan^2\{(\pi/8)\sqrt{(h_i/R_i')}\log_e(1-\gamma_i) + (\tfrac{1}{2}) \sin^{-1}\sqrt{\gamma_i} - (\tfrac{1}{2}k_i)\sqrt{(h_i/R_i')}\cdot(t_b - t_f)\} \quad (15)\text{-}1$$

where $R_i'$: flattened roll radius (mm)

$h_i$: exit strip thickness (mm)

$H_i$: entry strip thickness (mm)

$\gamma_i$: fractional reduction $=(H_i - h_i)/H_i$ $t_b$: back tension stress (kg/mm$^2$)

$t_f$: front tension stress (kg/mm$^2$)

$k_i$: resistance to deformation (rolling force) (kg/mm$^2$)

The forward slip can also be obtained using another known equation other than equation (15)-1.

Suppose neither the front tension stress $t_f$ nor the back tension stress $t_b$ changes. A change $\Delta f_i$ in the forward slip can then be approximated by the following equation:

$$\Delta f_i = (\partial f_i/\partial H_i)\Delta H_i + (\partial f_i/\partial h_i)\Delta h_i + (\partial f_i/\partial k_i)\Delta k_i \quad (16)$$

where $k_i$ is the strip resistance to deformation at the ith stand. A change $\Delta f_{i+1}$ in the forward slip at the (i+1)th stand can be obtained in the same manner using equation (16).

The change $\Delta h_{i+1}$ can also be obtained in accordance with equation (7) as follows:

$$\Delta h_{i+1} = \Delta S_{i+1} + (\Delta P_{i+1}/M_{i+1}) \quad (17)$$

A change $\Delta h_i$ in exit strip thickness at the ith stand can be obtained by equation (7):

$$\Delta h_i = \Delta S_i + (\Delta P_i/M_i) \quad (18)$$

Data of the change $\Delta h_i$ is supplied from the ith stand to the (i+1)th stand. That is, $$\Delta H_{i+1}(t) = \Delta h_i\{t - (L_i/v_i)\} \quad (19)$$

where t is time and $L_i$ is the distance between the ith and (i+1)th stands. As a result, the change $\Delta H_{i+1}$ of equation (15) is thus known.

Since the term $\Delta v_{Ri+1}/v_{Ri+1}$ of equation (15) is a corrected portion of the roll peripheral speed of the (i+1)th stand, this portion is regarded as zero for the final master stand of the finishing mill. Therefore, the term $\Delta v_{Ri+1}/v_{Ri+1}$ can be obtained from the roll speed correction value of the subsequent stand.

The constant mass flow control method thus controls the variation $\Delta v_{Ri}/v_{Ri}$ in the roll peripheral speed at the ith stand (i=1 to 6) of the finishing mill in accordance with equation (15).

According to the present invention as described above, in any continuous rolling mill having at least two stands, the roll gap of the ith stand is controlled in accordance with the exit strip thickness at the ith stand when a size such as a strip thickness is changed during rolling. Simultaneously when the roll gap is changed, the roll peripheral speed of the ith stand is controlled, so that the exit strip speed at the ith stand is equal to the entry strip speed at the (i+1)th stand. As a result, any deviation in the interstand tension is kept from affecting the size changing operation during rolling, thus performing smooth rolling.

Furthermore, even if a strip width is changed during rolling, a conventional automatic gauge control can be used.

Figure 4A:
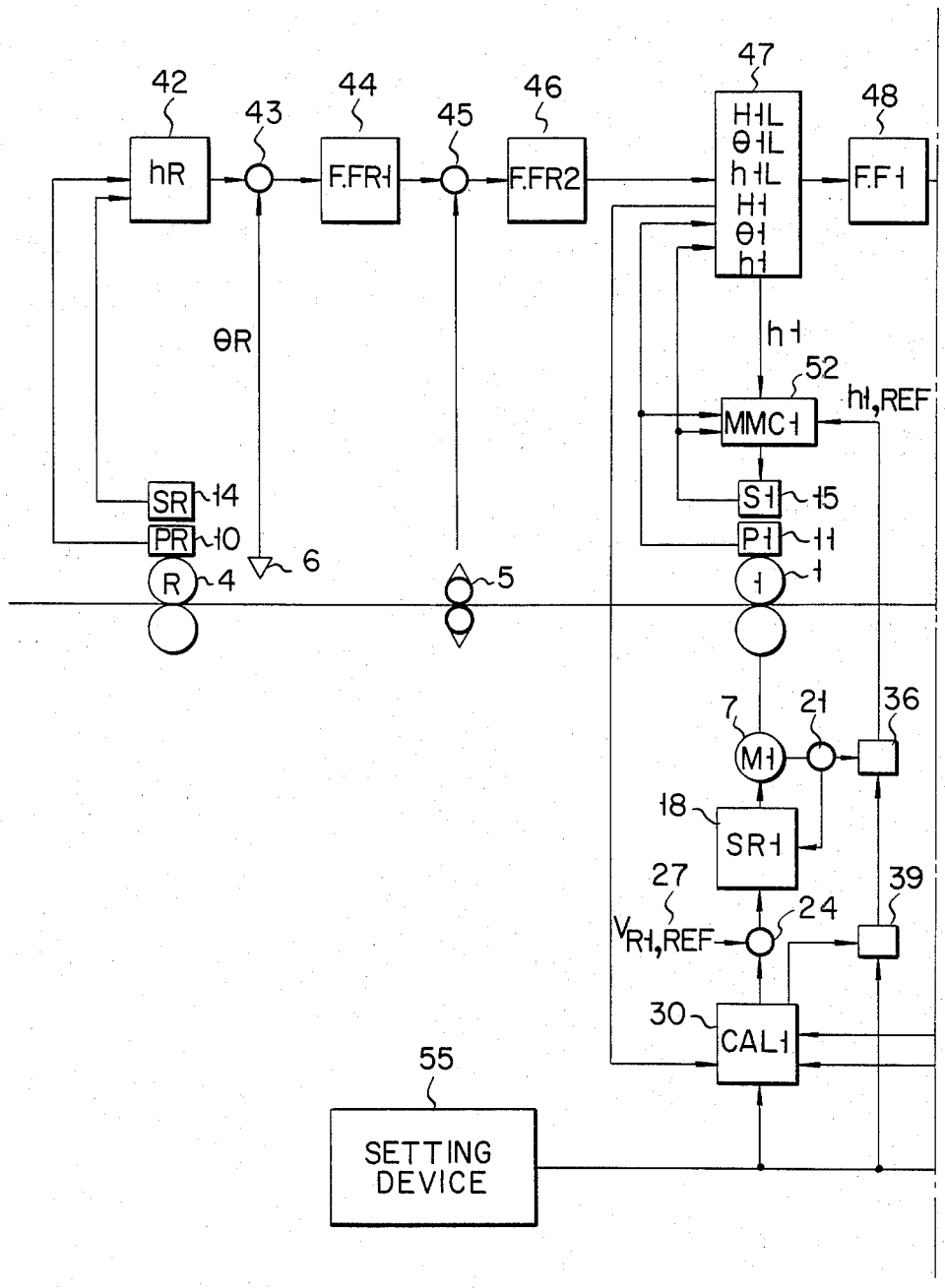
FIGS. 4A and 4B are block diagrams of a control apparatus for a continuous rolling mill according to an embodiment of the present invention.
Figure 4B:
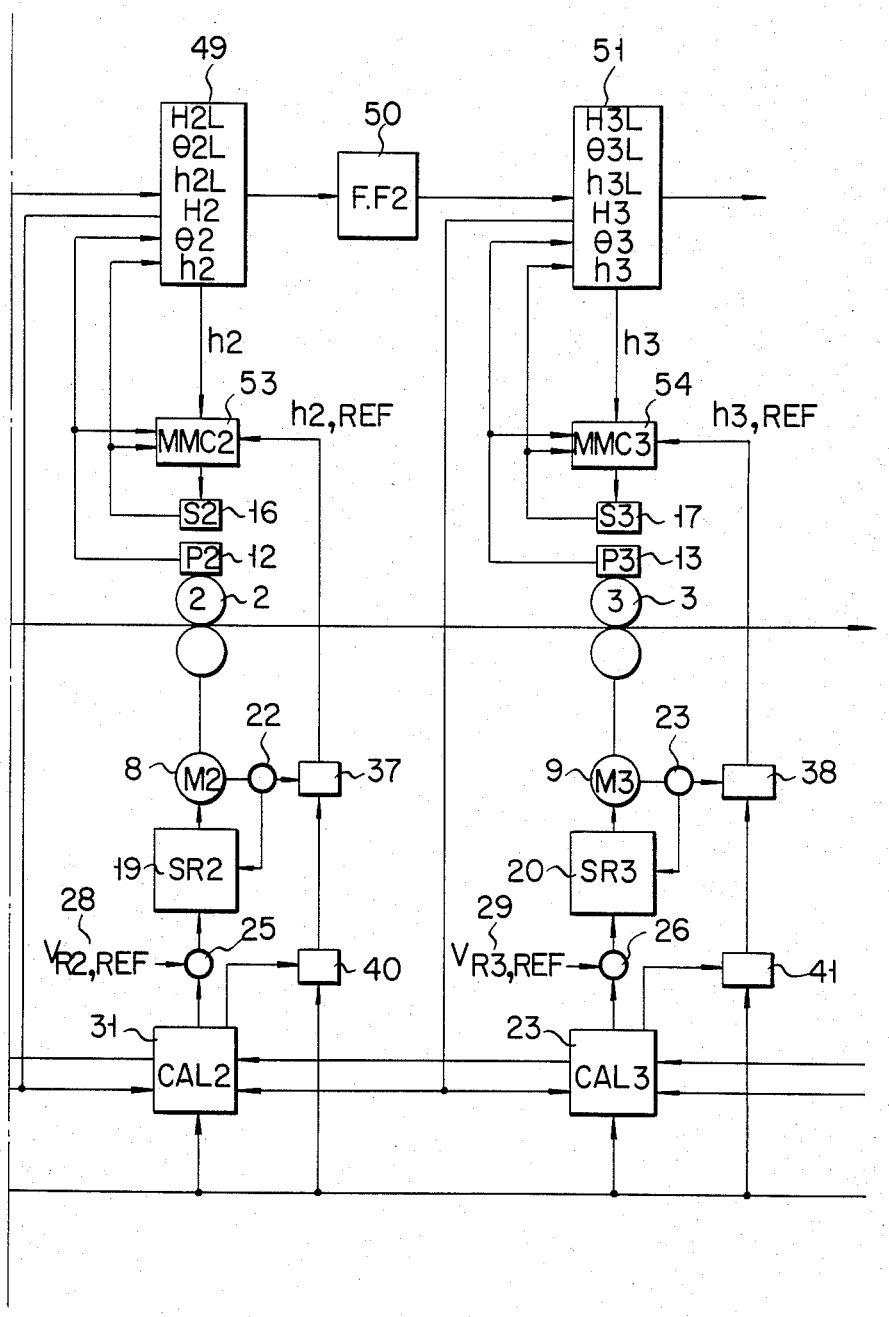

The control device according to the present invention will be described in detail with reference to FIGS. 4 and 5. FIG. 4 shows a case in which a 7-stand hot strip finish rolling mill is used as a continuous rolling mill. Reference numerals 1, 2 and 3 denote first, second and third stands respectively; and 4, a roughing mill which is disposed in front of the first to third stands 1 to 3. It is noted that the fourth to seventh stands are not illustrated in FIG. 4, but they have the same structure as the first to third stands 1 to 3.

Reference numeral 5 denotes a crop shear; 6, a thermometer of sheet bar; 7, 8 and 9, main drive motors; 10, 11, 12 and 13, load cells which are respectively arranged at the roughing mill 4 and the stands 1, 2 and 3; 14, 15, 16 and 17 are roll gap meters; 18, 19 and 20, speed regulators; 21, 22 and 23, speed sensors (tachometers); 24, 25 and 26, adders; 27, 28 and 29, roll speed reference voltages; 30, 31 and 32, constant mass flow computers; 36, 37, 38, 39, 40, 41 and 42, computing elements; 43, an adder; 44, 46, 48 and 50, delay apparatuses; 45, a cutoff length calculator; 47, 49 and 51, computing apparatuses; 52, 53 and 54, automatic gauge controls; and 55, a setting device for set-up calculation.

In the control apparatus having the arrangement described above, when the leading end of the material (sheet bar) is clamped between the rolls of the roughing mill 4, a signal corresponding to the rolling force $P_R$ measured by the load cell 10 of the roughing mill 4 is supplied to the computing element 42. A signal corresponding to the roll gap $S_R$ measured by the roll gap meter 14 is also supplied to the computing element 42. The computing element 42 computes the exit material thickness $h_R$ of the roughing mill 4 in accordance with equation (20) given below:

$$h_R = S_R + (P_R/M_R) \quad (20)$$

where $M_R$ is a constant determined by the mill spring constant of the roughing mill 4. When the leading end of the material reaches the thermometer 6 disposed at the exit side of the roughing mill 4, a material temperature $\theta_R$ is measured. Data of the measured material temperature $\theta_R$ is supplied to the adder 43. Data of the material thickness $h_R$ is supplied from the computing element 42 to the adder 43. Data of the material thickness $h_R$ and data of the material temperature $\theta_R$ are supplied to the cutoff length calculator 45 through the delay apparatus 44. Data of the material thickness $h_R$ and data of the material temperature $\theta_R$ for each material portion having a predetermined length are produced from the adder 43 and are delayed in the delay apparatus 44 in synchronism with the leading end of the material. When the material is cut by the crop shear 5, the cuttoff length calculator 45 measures a cut portion of the material. Data of the material thickness $h_R$ and its temperature $\theta_R$ after cutting are supplied from the cutoff length calculator 45 to the computing apparatus 47 through the delay apparatus 46. Data of the material thickness $h_{R1}$ is delayed by the delay apparatus 44 as follows:

$$h_{R1}(t)=h_R\{t-(L_{R1}/v_R)\} \quad (21)$$

where t is time, $L_{R1}$ is the distance between the roughing mill 4 and the crop shear 5, and $v_R$ is the material speed. The temperature $\theta_{R1}$ is given as follows:

$$\theta_{R1}(t)=\theta_R\{t-(L_{R1}/v_R)\} \quad (22)$$

Data of the entry strip thickness $H_1$ for the first stand of the finishing mill is delayed by the delay apparatus 46 as follows:

$$H_1(t)=h_{R1}\{t-(L_{R2}/v_R)\} \quad (23)$$

where $L_{R2}$ is the distance between the crop shear 5 and the first stand 1 of the finishing mill. The material temperature $\theta_{R2}$ is also delayed by the delay apparatus 46 as follows:

$$\theta_{R2}(t)=\theta_{R1}\}t-(L_{R2}/v_R)\} \quad (24)$$

However, since the material temperature drops between the roughing mill 4 and the first stand 1 of the finishing mill, data of the temperature drop is processed by the delay apparatus 46, so that the material temperature $\theta_1$ of the finishing mill is given as follows:

$$\theta_1=\{(A\epsilon/h_R)T_1+1/(\theta_{R2}+273)^3\}^{-\frac{1}{3}}-273 \quad (25)$$

where A is a constant, $\epsilon$ is emissivity, and $T_1$ is the delay time between the roughing mill 4 and the first stand 1 of the finishing mill. Data of the entry strip thickness $H_1$ of the first stand 1 of the finishing mill and of the strip temperature $\theta_1$ are temporarily stored in the computing apparatus 47. The stored pieces of data are represented by $H_{1L}$ and $\theta_{1L}$. When the leading end of the strip is clamped between the rolls of the first stand 1 of the finishing mill, signals from the load cell 11 and the roll gap meter 15 are supplied to the computing apparatus 47, so that the exit strip thickness $h_1$ of the first stand 1 is given by the following equation:

$$h_1=S_1+(P_1/M_1) \quad (26)$$

where $S_1$ is the roll gap of the first stand 1, $P_1$ is the rolling force of the first stand 1, and $M_1$ is the mill spring constant of the first stand 1. The exit thickness $h_1$ is also stored in the computing apparatus 47 with $H_{1L}$ and $\theta_{1L}$. The stored data is represented by $h_{1L}$.

Pieces of data of the exit strip thickness $h_1$ of the first stand 1 and the strip temperature $\theta_1$ are delayed by the delay circuit 48 to the second stand 2 in synchronism with the material speed. Data of the entry strip thickness $H_2$ of the second stand is delayed by the delay apparatus 48 as follows:

$$H_2(t)=h_1\{t-(L_1/v_1)\} \quad (27)$$

where t is time, $v_1$ is the strip speed at the exit of the first stand 1, and $L_1$ is the distance between the first stand 1 and the second stand 2. A delayed value $\theta_1'$ of the strip temperature $\theta_1$ is given as follows:

$$\theta_1'(t)=\theta_1\}t-(L_1/v_1)\} \quad (28)$$

Since the strip temperature decreases between the first and second stands 1 and 2, a strip temperature $\theta_2$ at the second stand 2 is corrected by the delay apparatus 48 as follows:

$$\theta_2=(\theta_1'-\theta_W)e^{-(2\alpha/c\gamma)\cdot(L1/h1v1)}+\theta_W \quad (29)$$

where $\theta_W$ is the cooling water temperature of the roll, c is the specific heat of the strip, $\gamma$ is the specific gravity of the strip, and $\alpha$ is the heat transfer coefficient of the finishing mill.

The entry strip thickness $H_2$ and the strip temperature $\theta_2$ at the entry of the second stand 2 can thus be obtained. In the same manner as described above, the entry strip thickness $H_i$, the strip temperature $\theta_i$ and the exit strip thickness $h_i$ with respect to the ith stand can be obtained. These values for each stand are obtained as instantaneous values during rolling.

The control will now be described for changing the roll gap when a size change is performed during rolling. The automatic gauge controls 52, 53 and 54 of the stands of the finishing mill shown in FIG. 4 have the same structure. Only the automatic gauge control 52 of the first stand 1 will be described. The automatic gauge control 52 receives data of the exit strip thickness reference $h_{1,REF}$, data of the gauge meter exit strip thickness $h_1$ from the computing apparatus 47, data of the rolling force from the load cell 11, and data of the roll gap $S_1$ from the roll gap meter 15.

Figure 5:
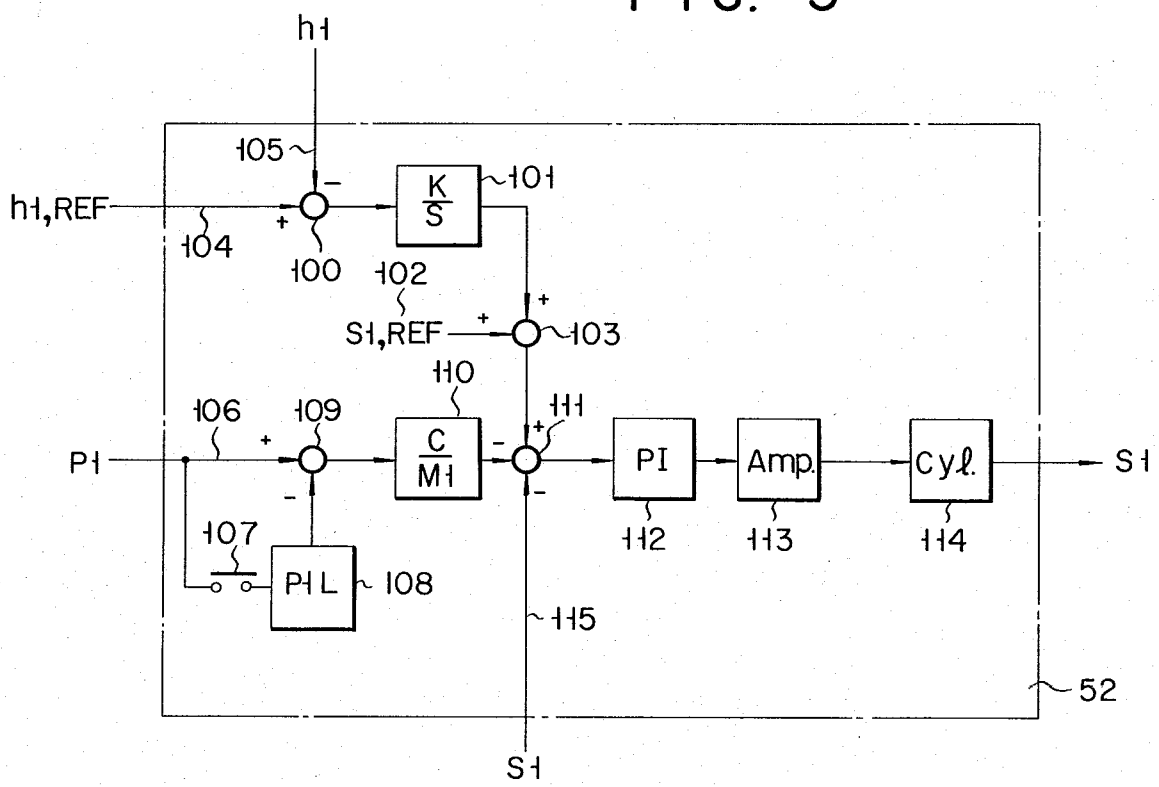
FIG. 5 is a block diagram of an automatic gauge control of the control apparatus shown in FIG. 4.

FIG. 5 shows the hydraulic type automatic gauge control 52. However, an electric type automatic gauge control may also be used. Referring to FIG. 5, reference numeral 100 denotes an adder; 101, an integrator having a gain; 102, the roll gap preset value ($S_{1,REF}$); 103, an adder; 104, the exit strip thickness reference ($h_{1,REF}$) to be described later; 105, the exit strip thickness ($h_1$) of the first stand 1 which is obtained by the computing apparatus 47 shown in FIG. 4; 106, the rolling force ($P_1$) from the load cell 11 shown in FIG. 4; 107, a relay which is closed when a predetermined time interval (e.g., 0.5 secs) has elapsed after the leading end of the sheet bar is clamped between the rolls of the first stand 1 and which is then immediately opened; 108, a memory for storing data of the rolling force $P_1$ while the circuit is closed; 109, an adder; 110, a multiplier; 111, a roll gap adder; 112, a PI controller; 113, a servo amp; 114, a hydraulic cylinder; and 115, a roll gap ($S_1$) obtained by the roll gap meter 15 shown in FIG. 4.

In the automatic gauge control having the structure described above, since the relay 107 is turned ON when the predetermined time interval (e.g., 0.5 second) has elapsed after the leading end of the sheet bar is clamped between the rolls of the first stand 1, data of the rolling force $P_1$ designated by reference numeral 106 is stored in the memory 108. For the rest of the sheet bar, a difference between the rolling force $P_1$ designated by reference numeral 106 and a rolling force $P_{1L}$ whose data is stored in the memory 108 is calculated by the adder 109. An output from the adder 109 is multiplied by $C/M_1$ by the multiplier 110, where C is any constant (e.g., 0.8) and $M_1$ is the mill spring constant of the first stand 1.

An output from the multiplier 110 is supplied to the roll gap adder 111, and an output from the roll gap adder 111 is supplied to the hydraulic cylinder 114 through the PI controller 112 and the hydraulic servo amp 113 so as to correct the roll gap. A feedback signal from the roll gap meter 15, and corresponding to the roll gap $S_1$ designated by reference numeral 115, is supplied to the adder 111.

The exit strip thicknesses reference $h_{1,REF}$ designated by reference numeral 104 is changed, so that the adder 100 is operated to obtain a difference between the exit strip thickness reference $h_{1,REF}$ or 104 and the exit strip thickness $h_1$ or 105. An output from the adder 100 is integrated by the integrator 101. The integrated signal is then supplied to the roll gap adder 111 through the adder 103. Therefore, the roll gap is corrected so as to make the exit strip thickness $h_1$ or 105 of the first stand 1 coincide with the exit strip thickness reference $h_{1,REF}$ or 104.

As described above, the automatic gauge control 52 corrects the roll gap $S_1$ of the first stand 1 so as to make the exit strip thickness reference $h_{1,REF}$ or 104 of the first stand 1 coincide with the exist strip thickness $h_1$ of the first stand 1. The above description is only made for the first stand 1, but also applies to the remaining stands.

The exit strip thickness reference value will now be described in detail. An identical operation is performed at every stand, so that only the operation of the first stand will be discussed. The rolling schedule of the finishing mill is determined by the setting device 55 shown in FIG. 4. The rolling schedule includes values for the entry strip thickness, the exit strip thickness, the strip temperature, the strip width, the resistance to deformation, the entry tension, the exit tension, the roll radius, the forward slip, the rolling force, the roll gap, the roll speed, and the exit strip length during size changing of each stand. The rolling schedule is set for schedules A and B.

The strip thickness and the strip length during size changing for schedules A and B are thus determined as described above. The strip thickness reference $h_{REF}$ in the size change during rolling is obtained as follows. The exit strip thickness reference value of the first stand of the finishing mill in the size change operation during rolling can be obtained by reference to equation (3) as follows:

$$h_1 = h_{1A} - \{(h_{1A} - h_{1B})/l_1\} l_{x1} \tag{30}$$

where $h_{1A}$ is the exit strip thickness of the first stand 1 for schedule A, $h_{1B}$ is the exit strip thickness of the first stand 1 for schedule B, $l_1$ is the exit strip length during size changing at the first stand 1, and $l_{x1}$ is the exit strip length during size changing from the size changing point to the first stand 1. Therefore, data of $h_{1A}$, $h_{1B}$, and $l_1$ of equation (30) is supplied from the setting device 55 to the computing element 39. The computing element 39 receives data of the forward slip $f_1$ from the computer 30 and performs the operation of $(1+f_1)$. The data of $h_{1A}$, $h_{1B}$, $l_1$ and $(1+f_1)$ is supplied to the computing element 36. The computing element 36 also receives a signal $N_1$ from the speed sensor 21 of the main drive motor 7 of the first stand 1 to calculate $l_{x1}$:

$$l_{x1} = \int (1+f_1)(2\pi R_1/60) N_1 dt \tag{31}$$

where $R_1$ is the roll radius of the first stand 1. The exit strip thickness reference $h_{1,REF}$ of the first stand, which corresponds to the output from the computing element 16, is obtained by reference to equations (30) and (31):

$$h_{1,REF} = h_{1A} - (h_{1A} - h_{1B})/l_1 \int (1+f_1)(2\pi R_1/60) N_1 dt \tag{32}$$

Data of the exit strip thickness reference $h_{1,REF}$ of the first stand 1 is supplied to the automatic gauge control 52. The exit strip thickness reference values of the remaining stands 2 to 7 are also obtained in the same manner as described above.

The change in roll speed in the size change operation during rolling will be described below. The roll speed can be properly changed in accordance with the constant mass flow control. The values represented by equation (15) may be instantaneously calculated during rolling.

The constant mass flow control will be described in detail. The roll speeds of all the stands can be changed in the same manner in accordance with the constant mass flow control, so that only a change in roll speed of the first stand will be discussed. According to equation (15), $$\Delta v_{R1}/v_{R1} = -(\Delta f_1/1+f_1) + (\Delta f_2/1+f_2) + (\Delta h_2/h_2) - (\Delta H_2/H_2) + (\Delta V_{R2}/V_{R2}) \tag{32-1}$$

Regarding the changes in forward slip which are numerators of the first and second terms on the right side, $\Delta f_1$ of the first term can be directly obtained from equation (16) and $\Delta f_2$ of the second term can also be obtained. The calculation of $\Delta f_1$ is given in the equation shown below:

$$\Delta f_1 = (\partial f_{1A}/\partial H_{1A})\Delta H1 + (\partial f_{1A}/\partial h_{1A})\Delta h_1 + (\partial f_{1A}/\partial k_{1A})\Delta k_1 \tag{32-2}$$

Referring to FIG. 4, values required to calculate equation (32)-2 are supplied as schedules A and B from the setting device 55 to the constant mass flow computer 30. The operation of the constant mass flow computer 30 will be described below.

Regarding the forward slip $f_{1A}$ of the first stand for schedule A, the following relation is given:

$$Z_{1A} = H_{1A} - h_{1A} + (C_1 M_1/B_A)(h_{1A} - S_{1A}) \tag{33}$$

Let the $f_{1C}$ be:

$$f_{1C} = \tfrac{1}{2}\{\sqrt{h_{1A}(H_{1A} - h_{1A})}/R_1 Z_{1A}(\pi/4 \cdot \log_e (h_{1A}/H_{1A}) - 1/k_{1A}(t_{bA} - t_{fA})) + \sin^{-1}\sqrt{\gamma_{1A}}\} \tag{34}$$

for $$\gamma_{1A} = (H_{1A} - h_{1A})/H_{1A} \tag{35}$$

where the number 1 is the stand number, A refers to the schedule A, $B_A$ is the strip width, $C_1$ is a constant, $R_1$ is the roll radius, $t_{bA}$ is the back tension, $t_{fA}$ is the forward tension, $\gamma_{1A}$ is the fractional reduction, and $k_{1A}$ is the resistance to deformation.

According to equation (15)-1, $$\partial f_{1A}/\partial H_{1A} = 2 \tan f_{1C}(1/\cos^2 f_{1C})(\partial f_{1C}/\partial H_{1A}) \tag{35-1}$$

for $$\partial f_{1C}/\partial H_{1A} = \tfrac{1}{4}\{((\pi/4)\log_e(h_{1A}/H_{1A}) - (t_{bA} - t_{fA})/k_{1A}) \cdot 1/\sqrt{R_1 Z_{1A}} \cdot (\sqrt{h_{1A}/(H_{1A} - h_{1A})} - \sqrt{h_{1A}(H_{1A} - h_{1A})/Z_{1A}} - 1/H_{1A} \cdot (\pi/2)\sqrt{h_{1A}(H_{1A} - h_{1A})} / \sqrt{R_1 Z_{1A}} - \sqrt{h_{1A}/(H_{1A} - h_{1A})}\} \quad (36)$$

Then, $$\partial f_{1A}/\partial h_{1A} = 2 \tan f_{1C}(1/\cos^2 f_{1C})(\partial h_{1C}/\partial h_{1A}) \quad (37)$$

for $$\partial f_{1C}/\partial h_{1A} = \tfrac{1}{4}\{((\pi/4)\log_e(h_{1A}/H_{1A}) - (t_{bA} - t_{fA})/k_{1A}) \cdot 1/\sqrt{R_1 Z_{1A}} \cdot ((H_{1A} - 2h_{1A})/\sqrt{h_{1A}(H_{1A} - h_{1A})} - \sqrt{h_{1A}(H_{1A} - h_{1A})}\,((C_1 M_1)/B_A - 1)/Z_{1A}) + (\pi/2)\sqrt{(H_{1A} - h_{1A})/h_{1A}} \cdot (1/\sqrt{R_1 Z_{1A}}) - (1/\sqrt{h_{1A}(H_{1A} - h_{1A})}\} \quad (38)$$

Then, $$\partial f_{1A}/\partial k_{1A} = 2 \tan f_{1C}(1/\cos^2 f_{1C})(\partial f_{1C}/\partial k_{1A}) \quad (39)$$

for $$\partial f_{1C}/\partial k_{1A} = (\tfrac{1}{2})\sqrt{h_{1A}(H_{1A} - h_{1A})/(R_1 Z_{1A})} \cdot (t_{bA} - t_{fA})/k^2_{1A} \quad (40)$$

The partial differential coefficients of the forward slip $f_{1A}$ of the first stand with respect to the entry strip thickness $H_{1A}$, the exit strip thickness $h_{1A}$, and the resistance to deformation $k_{1A}$ can be obtained.

In the same manner as described above, the pieces of data of the schedules A and B are supplied from the setting device 55 shown in FIG. 4 to the constant mass flow computer 31. The operation of the constant mass flow computer 31 is the same as that of the constant mass flow computer 30 of the first stand 1. The number 1 is replaced by the number 2 in equations (33) to (40). From the calculated results, the partial differential coefficients of the forward slip $f_{2A}$ of the second stand 2 with respect to the entry strip thickness $H_{2A}$, the exit strip thickness $h_{2A}$, and the resistance to deformation $k_{2A}$ are obtained.

The pieces of data of the entry strip thickness H, the strip temperature $\theta$, and the exit strip thickness h which are obtained immediately before the size changing point X reaches each stand are stored in the computing apparatuses 47, 49 and 51. This data is defined as $H_{1L}$, $\theta_{1L}$ and $h_{1L}$ for the first stand 1, and as $H_{2L}$, $\theta_{2L}$ and $h_{2L}$ for the second stand 2. Similar definitions can be made for subsequent stands.

The outputs corresponding to $H_{1L}$, $\theta_{1L}$ and $h_{1L}$ and the instantaneous values $H_1$, $\theta_1$ and $h_1$ are supplied from the computing apparatus 47 to the constant mass flow computer 30. At the second stand, the outputs from the computing apparatus 49 are supplied to the constant mass flow computers 30 and 31. Similar data transfer is performed at subsequent stands.

The constant mass flow computer 30 computes the following changes with reference to equation (16):

$$\Delta H_1 = H_1 - H_{1L} \quad (41)$$

$$\Delta h_1 = h_1 - H_{1L} \quad (42)$$

$$\Delta k_1 = k_1(\theta_1) - k_{1L}(\theta_{1L}) \quad (43)$$

The resistance to deformation $k_1$ of equation (43) is obtained from the following equation:

$$k_1 = 0.00385(46.608 - 0.02987\theta) \times (10.099 + 31.172\gamma - 29.842\gamma^2) \times \{11.153 + 2.7425 \log 10\lambda + 0.68352(\log 10\lambda)^2\} \quad (43)\text{-}1$$

where $\theta$ is the strip temperature (material temperature) (°C.), $\lambda$ is the strain rate (1/S), and $\gamma$ is the fractional reduction (—). In the same manner as described above, the constant mass flow computer 31 of the second stand 2 calculates the following values:

$$\Delta H_2 = H_2 - H_{2L} \quad (44)$$

$$\Delta h_2 = h_2 - h_{2L} \quad (45)$$

$$\Delta k_2 = k_2(\theta_2) - k_{2L}(\theta_{2L}) \quad (46)$$

The constant mass flow computer 30 of the first stand 1 instantaneously computes the change in forward slip $\Delta f_1$ of the first stand in accordance with the following equation with reference to the value of equation (32)-2 from equations (33) to (43):

$$\Delta f_1 = (\partial f_{1A}/\partial H_{1A})\Delta H_1 + (\partial f_{1A}/\partial h_{1A})\Delta h_1 + (\partial f_{1A}/\partial k_{1A})\Delta k_1 \quad (47)$$

In the same manner as described above, using the value of equation (16) which is obtained from equations (44) to (46) where the number 1 is replaced by the number 2, the constant mass flow computer 31 instantaneously computes the change in forward slip $\Delta f_2$ of the second stand 2 as follows:

$$\Delta f_2 = (2f_{2A}/2H_{2A})\Delta H_2 + (\partial f_{2A}/\partial h_{2A})\Delta h_2 + (\partial h_{2A}/\partial k_{2A})\Delta k_2 \quad (48)$$

The changes in forward slip of the subsequent stands can be obtained in the same manner as described above.

Equation (15)-1 is used to obtain the forward slip $f_1$ of the denominator of the first term of the right side of equation (32)-1.

$$f_1 = \tan^2\{(\pi/8)\sqrt{h_1/R_1'}\,\log_e(1 - \gamma_1) + (\tfrac{1}{2})\sin^{-1}\sqrt{\gamma_1} - (\tfrac{1}{2}k_1)\sqrt{h_1/R_1'}\,(t_b - t_f)\} \quad (49)$$

where $R_1'$ is the flattened roll radius. The constant mass flow computer 30 of the first stand 1 performs calculation in accordance with equation (49). The constant mass flow computer 31 of the second stand 2 performs calculation in accordance with equation (49) where the number 1 is replaced with the number 2. In other words, the constant mass flow computer 31 calculates the forward slip $f_2$. As a result, the forward slips f of the stands are thus obtained.

The values thus obtained are supplied to the constant mass flow computer 30 of the first stand 1, and the constant mass flow computer 30 changes the roll peripheral speed in the size change during rolling as follows:

$$\Delta v_{R1}/v_{R1} = -\{\Delta f_1/(1+f_1)\} + \{\Delta f_2/(1+f_2)\} + (\Delta h_2/h_2) - (\Delta H_2/H_2) + (\Delta v_{R2}/v_{R2}) \quad (50)$$

The values of the denominators of equation (50) correspond to those before size changing occurs.

In the same manner, the constant mass flow computer 31 of the second stand 2 computes a change in roll peripheral speed in the size change operation during rolling as follows:

$$\Delta v_{R2}/v_{R2} = -\{\Delta f_2/(1+f_2)\} + \{\Delta f_3/(1+f_3)\} + (\Delta f_3/h_3) - (\Delta H_3/H_3) + (\Delta v_{R3}/v_{R3}) \quad (51)$$

The calculations for the subsequent stands are performed in the same manner as described above. The values are computed by the constant mass flow computer 32 in accordance with equations (50) and (51). The calculated results are supplied to the corresponding stand. When the 7-stand finishing mill is used, that is, when the seventh stand is regarded as the reference stand, the speed of the seventh stand is constant. In other words, $\Delta v_{R7}/v_{R7}$ is zero. The output (corresponding to $\Delta v_{R1}/v_{R1}$) from the constant mass flow computer 30 of the first stand 1 and the value (corresponding to $v_{R1,REF}$) of the roll speed setter 27 are added by the adder 24. The sum data is then supplied to the speed regulator 18. The speed regulator 18 corrects the speed of the main drive motor 7, so that the roll speed can be changed in the size change operation during rolling. The operations for the remaining stands are performed in the same manner as described above. As a result, the size change operation during rolling can be stably performed, and a deviation in the interstand tension is very small.

The present invention is not limited to the particular embodiment described above. The following modifications, for example, may be made within the spirit and scope of the present invention:

(1) The constant mass flow control is only performed in the size change operation during rolling in the above embodiment. The constant mass flow control can be performed for ordinary rolling as well, thus providing further complete control. In this case, the pieces of data of the entry strip thickness, the strip temperature, the exit strip thickness and so on are stored when a predetermined time interval (e.g., 0.5 second) has elapsed after the leading end of the strip is clamped between the rolls of the stand, thereby performing the subsequent constant mass flow control.

(2) In the above embodiment, data of the exit strip thickness reference value is supplied to the automatic gauge control of the corresponding stand when the size change is performed during rolling. However, the roll gap values in the size change operation during rolling and from schedule B are directly supplied to the hydraulic cylinder of the rolling mill (specifically, they are supplied as the roll gap $S_1$ or 115) so as to change the roll gap. The roll speed may be changed in accordance with the constant mass flow control in the size change during rolling.

(3) In the above embodiment, the speed of the reference stand in the size change operation during rolling is not changed. However, when the exit temperature control of the rolling mill is incorporated, the speed of the reference stand can be corrected by a difference between the reference temperature and the actual temperature. In this case, the stand speed is corrected corresponding to a percentage of the speed correction of the reference stand.

(4) In the above embodiment, the roll speed is changed in accordance with the constant mass flow control of an upstream type. However, a downstream type control may also be utilized in which the speed on the downstream side is corrected.

(5) The values of the rolling schedule in the size change operation during rolling or the size change after rolling can be supplied to an attachment of the continuous rolling mill, such as a guide, looper, and various types of measuring equipment.

(6) The continuous rolling mill need only have a minimum of two stands. The resistance to deformation can also be obtained in accordance with the rolling force and the strip thickness at each stand of the continuous rolling mill.

(7) The present invention may be applied to any continuous rolling mill for producing a steel wire, a steel rod, a steel product of any shape, or a steel plate.

(8) The method for changing the roll gap in the size change operation during rolling can be applied to a single stand rolling mill, such as a plate mill and a reverse mill.

The roll gap of the ith stand can be changed in correspondence with the exit strip thickness of the ith stand when a size change (e.g., thickness) during rolling is performed with a continuous rolling mill having at least two stands. Furthermore, simultaneous with the changing of the roll gap of the ith stand, the roll speed can also be changed in accordance with the constant mass flow control in which the strip speed at the exit of the ith stand is equal to that at the entrance of the (i+1)th stand. Even if rolling conditions such as resistance to deformation caused by strip hardness, strip temperature, or the friction coefficient between the roll and the strip, and such as exit and entry strip size, forward slip, and rolling force are instantaneously changed, smooth size changing is performed.

What is claimed is:

1. A method for controlling a continuous hot rolling mill having at least ith and (i+1)th stands, wherein an exit strip thickness reference value of an automatic gauge control is changed in accordance with a predetermined strip length during size changing and roll gap is corrected so as to change a strip thickness at an exit side of the ith stand, when a size (e.g., thickness) is changed during rolling, and, at the same time, a roll peripheral speed of the ith stand is changed in correspondence with a change in forward slip (a change in entry strip thickness, a change in exit strip thickness, and a change in resistance to deformation) of the ith stand as well as changes in forward slip, exit strip thickness, entry strip thickness and roll peripheral speed of the (i+1)th stand, in accordance with the following equations, so as to make the strip speed at the exit side of the ith stand coincide with the strip speed at an entry side of the (i+1)th stand:

$$\Delta V_{Ri}/V_{Ri} = -\Delta f_i/(1+f_i) + \Delta f_{i+1}/(1+f_{i+1}) + \Delta h_{i+1}/h_{i+1} - \Delta H_{i+1}/H_{i+1} + \Delta V_{Ri+1}/V_{Ri+1}$$

where $V_R$: roll peripheral speed
f: forward slip
h: exit strip thickness
H: entry strip thickness
i, i+1: stand numbers
Δ: a small change and $$f_i = (\partial f_i/\partial H_i)\Delta H_i + (\partial f_i/\partial h_i)\Delta h_i + (\partial f_i/\partial k_i)\Delta k_i$$

where k: strip resistance to deformation
∂f/∂H: partial differential coefficient
∂f/∂h: partial differential coefficient
∂f/∂k: partial differential coefficient.

2. A control apparatus of a continuous hot rolling mill having at least two stands, that is, ith and (i+1)th stands, comprising:

a setting computer for calculating and setting a rolling schedule (entry and exit strip thicknesses, a strip width, a roll radius, a strip resistance to deformation, a forward tension, a back tension, a roll peripheral speed, and a strip length during size changing) for each of said stands;

a delay apparatus for delaying values from an entry strip thermometer and an entry strip thickness computer of said continuous rolling mill;

a computing apparatus for computing an exit strip thickness from outputs from a roll gap meter and a load sensor which measure a roll gap and a rolling force, respectively;

a delay circuit for delaying an output from said computing apparatus;

a constant mass flow computer which receives storage values and computed values of the entry strip thickness, the strip temperature and the exit strip thickness from said setting computer and said computing apparatus as well as the values of the forward slip, the exit strip thickness, the entry strip thickness and the roll peripheral speed of a next stand from a mass flow computer of the next stand and changes therein, said constant mass flow computer being adapted to compute changes in the resistance to deformation obtained from the strip temperature, in the entry strip thickness and the exit strip thickness, and in a fractional differential coefficient of the forward slip of each of said stands, to compute the forward slip and a change therein from computed changes, and to produce an output signal which allows a change in the roll peripheral speed;

an automatic gauge control for performing automatic gauge control in response to signals from said roll gap meter and said load sensor; and a computer for instantaneously computing an exit strip thickness reference value for said automatic gauge control in accordance with an output from said setting computer, and with the forward slip and the roll peripheral speed.

3. An apparatus according to claim 2, wherein said automatic gauge control corrects the roll gap in accordance with a difference between the exit strip thickness obtained by said computer apparatus and the exit strip thickness reference value in a size change operation during rolling, and in accordance with the change in the rolling force in the size change operation during rolling.

* * * * *